US010434434B1

(12) United States Patent
Thai

(10) Patent No.: US 10,434,434 B1
(45) Date of Patent: Oct. 8, 2019

(54) BUBBLE GENERATING ASSEMBLY

(71) Applicant: Placo Bubbles Limited, TST East, Kowloon (HK)

(72) Inventor: Douglas Thai, TST East (HK)

(73) Assignee: Placo Bubbles Limited, Hong Kong (HK)

( * ) Notice: Subject to any disclaimer, the term of this patent is extended or adjusted under 35 U.S.C. 154(b) by 0 days.

(21) Appl. No.: 16/427,049

(22) Filed: May 30, 2019

(51) Int. Cl.
*A63H 33/28* (2006.01)
*A63H 29/22* (2006.01)

(52) U.S. Cl.
CPC ..... *A63H 33/28* (2013.01); *A63H 29/22* (2013.01)

(58) Field of Classification Search
CPC ..... A63H 33/00; A63H 33/28; A63H 37/00; A63H 29/00; A63H 29/22; A63J 5/025
USPC ..... 446/15–21, 473, 484, 475
See application file for complete search history.

(56) References Cited

U.S. PATENT DOCUMENTS 6,616,498 B1 * 9/2003 Thai ..... A63H 33/28 446/15
6,682,570 B2 1/2004 Thai
7,367,861 B2 5/2008 Thai
8,123,584 B2 2/2012 Thai
2004/0266309 A1 * 12/2004 Thai ..... A63H 33/28 446/15
2007/0270073 A1 * 11/2007 Thai ..... A63H 33/28 446/15
2007/0298674 A1 * 12/2007 Ivanic ..... A63H 33/28 446/15
2011/0287685 A1 * 11/2011 Lam ..... A63H 33/28 446/15
2012/0214378 A1 8/2012 Lo

* cited by examiner

*Primary Examiner* — Kien T Nguyen
(74) *Attorney, Agent, or Firm* — Raymond Sun

(57) ABSTRACT

A bubble generating device has a bubble generating assembly positioned adjacent a front opening. The bubble generating assembly has a support frame having a stationary wiping element, and a plurality of bubble wands coupled to the support frame for rotation in a manner where each of the plurality of bubble wands individually wipes across the wiping element at the location of the opening. A motor is positioned inside the housing and has a fan that is directed to blow air towards the front opening. Bubble solution is delivered from a container to the wiping element. A link assembly couples the motor and the support ring in a manner in which actuation of the trigger causes the support ring to be rotated so that each of the plurality of bubble wands is wiped across the wiping element and then positioned in front of the fan to receive air blown by the fan.

16 Claims, 16 Drawing Sheets

BUBBLE GENERATING ASSEMBLY

BACKGROUND OF THE INVENTION

1. Field of the Invention

The present invention relates to bubble toys, and in particular, to a bubble generating assembly configured as a bubble gun and which generates a continuous stream of bubbles.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. No. 6,149,486 (Thai), U.S. Pat. No. 6,331,130 (Thai) and U.S. Pat. No. 6,200,184 (Rich et al.). The bubble rings in the bubble generating assemblies in U.S. Pat. No. 6,149,486 (Thai), U.S. Pat. No. 6,331,130 (Thai) and U.S. Pat. No. 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

In response to these deficiencies, new bubble generating assemblies were provided in U.S. Pat. No. 6,682,570 (Thai), U.S. Pat. No. 7,367,861 (Thai) and U.S. Pat. No. 8,123,584 (Thai) which automatically formed a bubble film over a bubble ring without the need to dip the bubble ring into a container or a dish of bubble solution. However, the number and nature of the generated bubbles were limited. For example, these assemblies could not generate a large quantity of bubbles, and usually could only generate bubbles of the same size.

Thus, there remains a need to provide an apparatus and method for forming a film of bubble solution across a bubble ring without the need to dip the bubble ring into a dish of bubble solution, and which provides greater variety in play and entertainment.

SUMMARY OF THE DISCLOSURE

In order to accomplish the objects of the present invention, there is provided a bubble generating device having a housing having a front opening, with a bubble generating assembly positioned adjacent the front opening. The bubble generating assembly has a support frame having a stationary wiping element that has a front face that has a plurality of recessed channels is defined therein. These channels define separate face pieces, and openings can be provided on one or more of these face pieces through which bubble solution can exit or leak out. The bubble generating assembly also includes a support ring and a plurality of bubble wands provided on the support ring, with the support ring coupled to the support frame for rotation in a manner where each of the plurality of bubble wands individually wipes across the wiping element at the location of the opening. Each of the plurality of bubble wands has a surface area that is smaller than the entire surface area of the wiping element. A motor is positioned inside the housing and has a fan that is directed to blow air towards the front opening. A container is coupled to the housing and retains bubble solution. A tubing couples the interior of the container with the wiping element, and a pump system is coupled to the motor, and actuated by the motor, for delivering bubble solution from the interior of the container through the tubing and to the wiping element. A link assembly couples the motor and the support ring in a manner in which actuation of the motor causes the support ring to be rotated so that each of the plurality of bubble wands is wiped across the wiping element and then positioned in front of the fan to receive air blown by the fan.

BRIEF DESCRIPTION OF THE DRAWINGS

FIGS. 4A and 4B illustrate how the actuation of the trigger closes the electrical switch.

FIG. 5A illustrates the electrical switch being seated inside a contact seat.

FIG. 5B is an exploded view of the electrical contact and the contact seat.

DETAILED DESCRIPTION OF THE PREFERRED EMBODIMENTS

Figure 1:
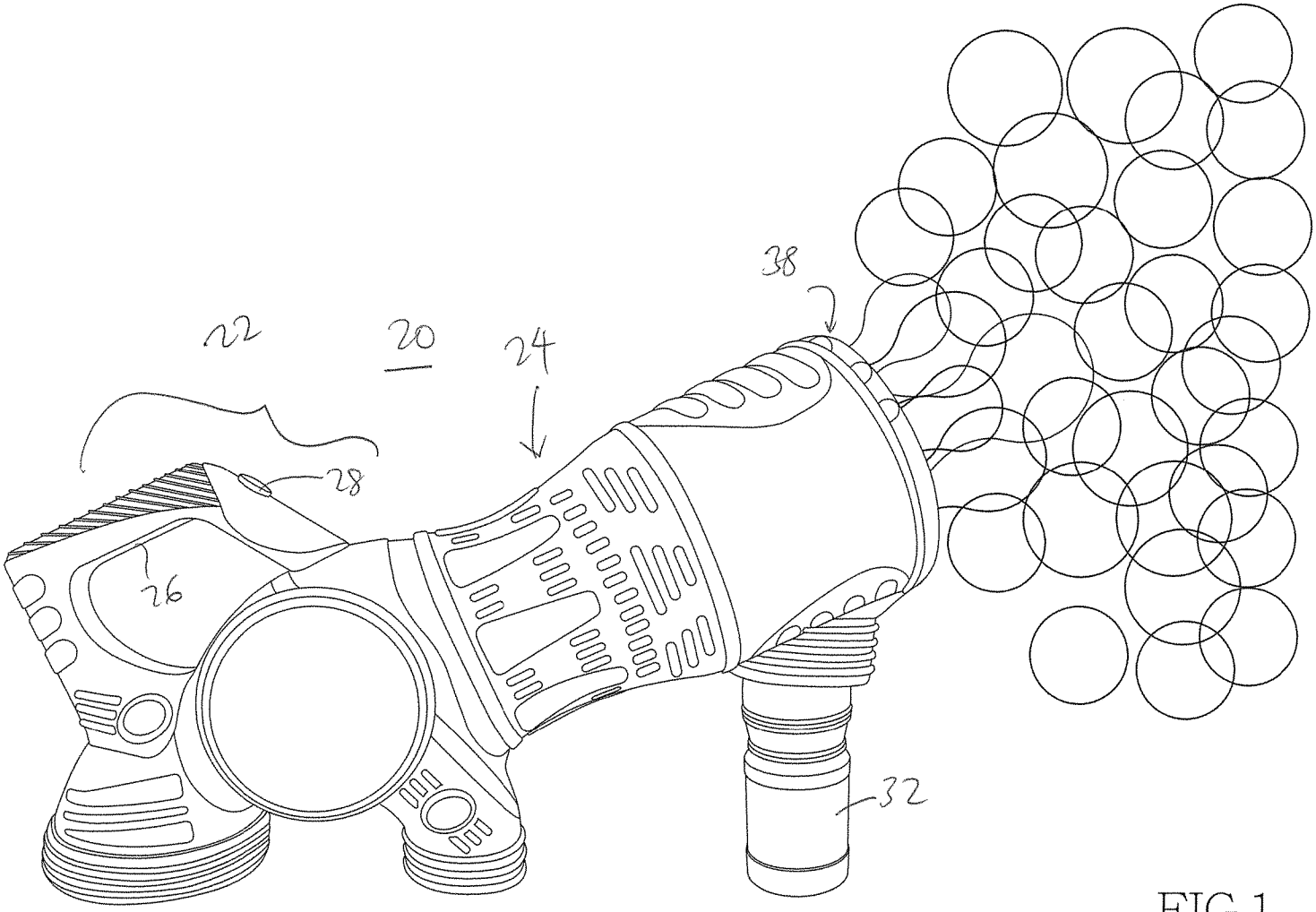
FIG. 1 is a side view of a bubble generating assembly or device according to one embodiment of the present invention.
Figure 2:
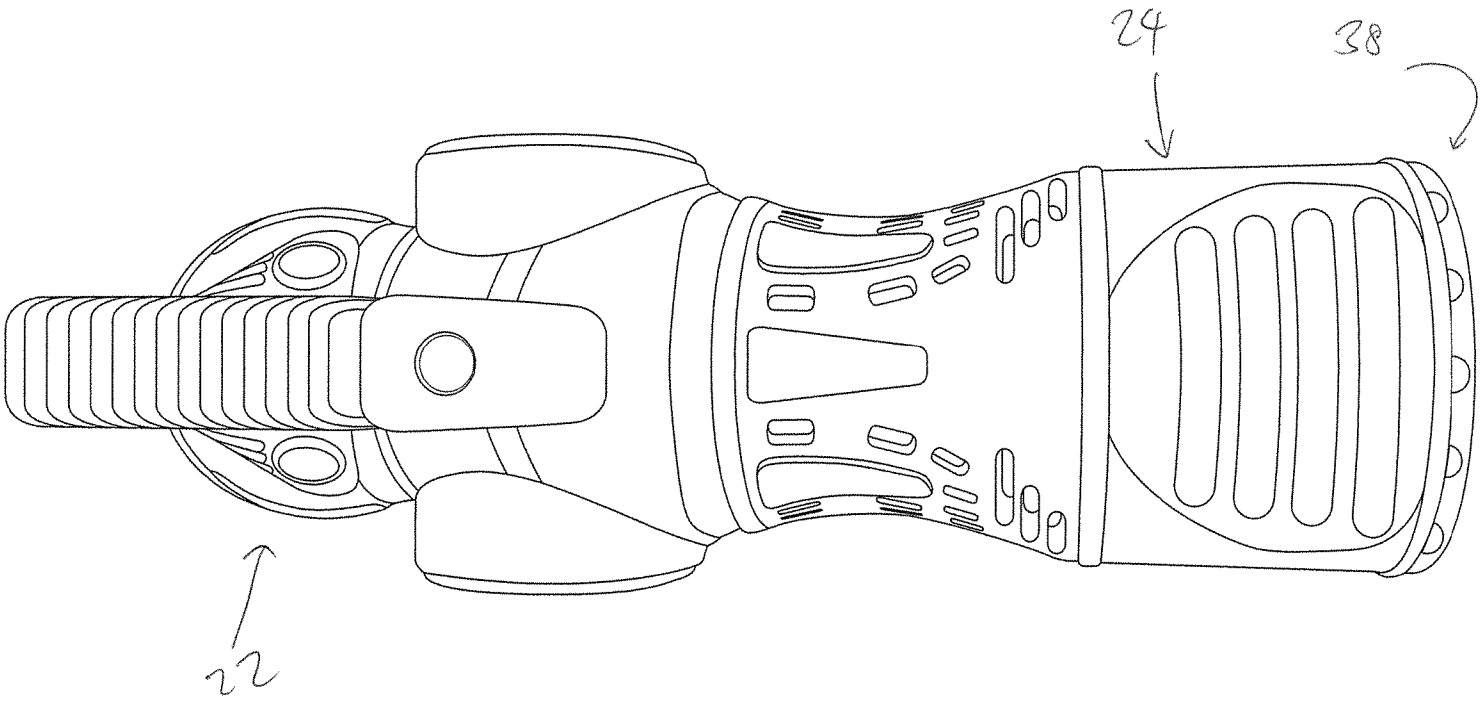
FIG. 2 is a top view of the assembly of FIG. 1.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a bubble generating assembly that can, upon actuating a trigger, generate a stream of bubbles without the need to manually dip a bubble ring into bubble solution. Optionally, a series of LED lights can also be illuminated.

FIGS. 1-17 illustrate one embodiment of a bubble generating assembly or device 20 according to the present invention. The assembly 20 has a housing that includes a handle section 22 and a barrel section 24. The housing can be provided in the form of two symmetrical outer shells that are connected together by, for example, screws or welding or glue. These outer shells together define a hollow interior for housing the internal components of the assembly 20, as described below. The handle section 22 has an inner surface 26 that can be gripped by the hand of a user, and a trigger 28 adjacent the top of the handle section 22 along an outer surface thereof.

Figure 3:
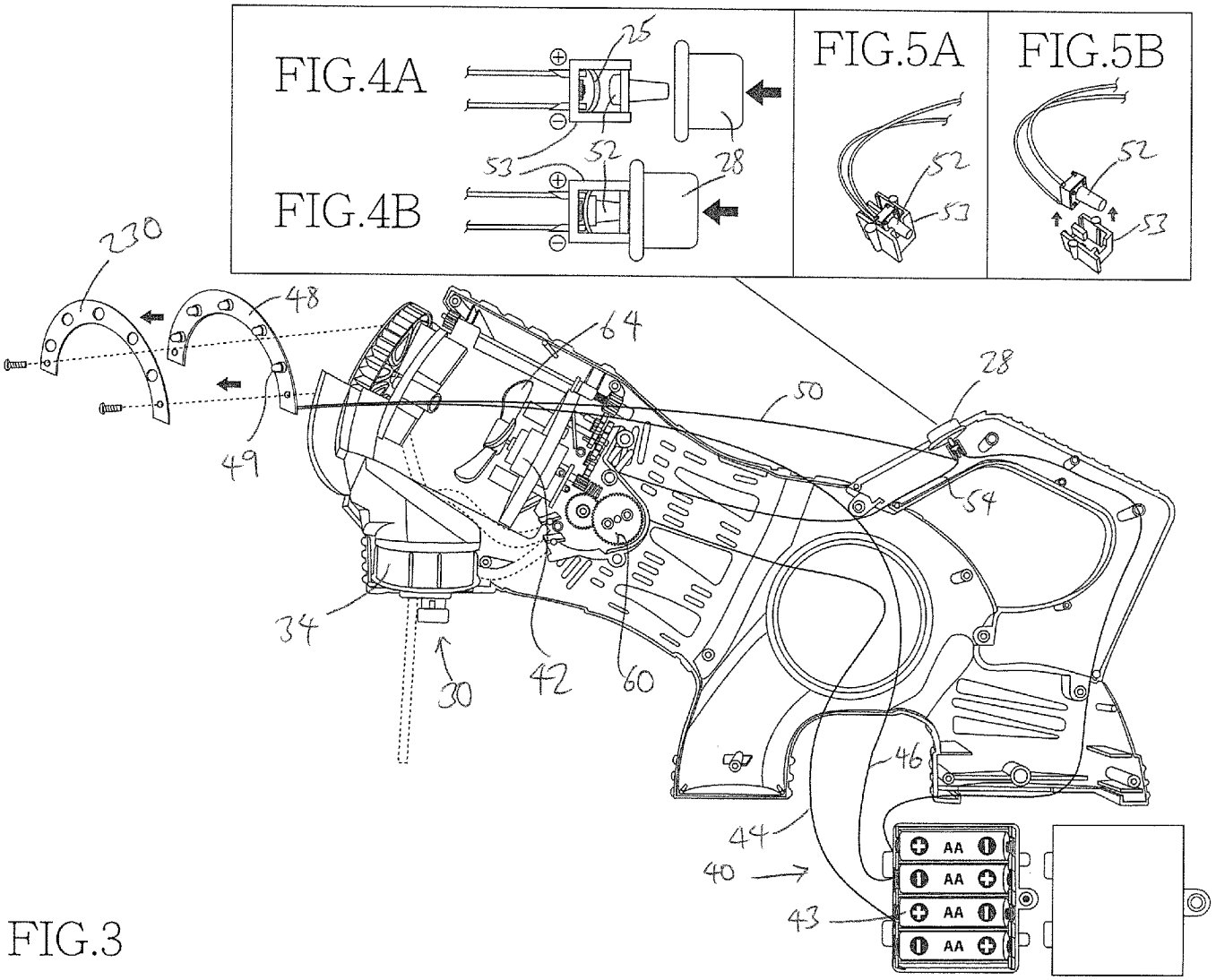
FIG. 3 is a side view of the assembly of FIG. 1 shown with the housing removed.
Figure 6:
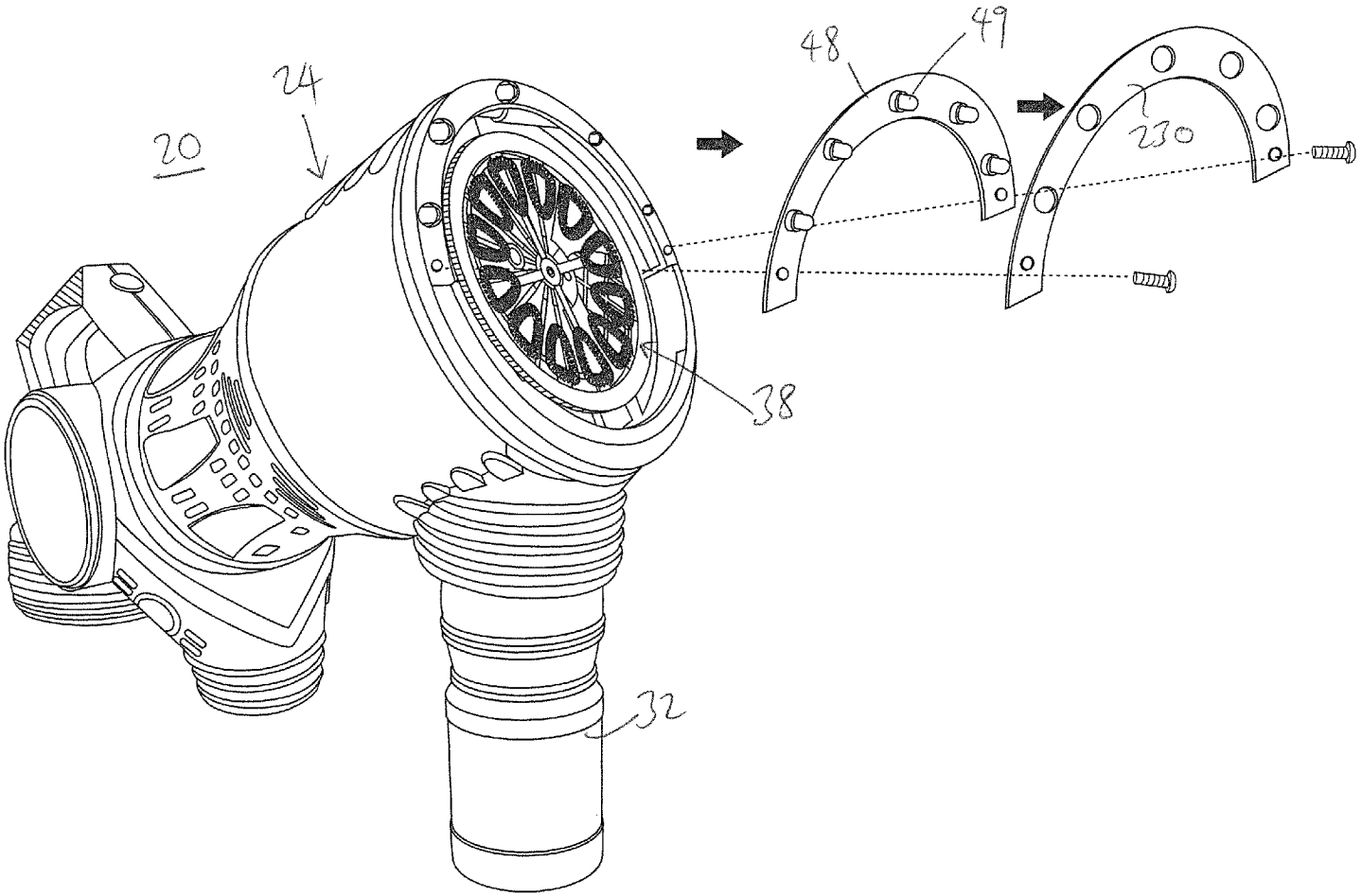
FIG. 6 is an exploded front perspective view of the assembly of FIG. 1 showing the LED lights.
Figure 8:
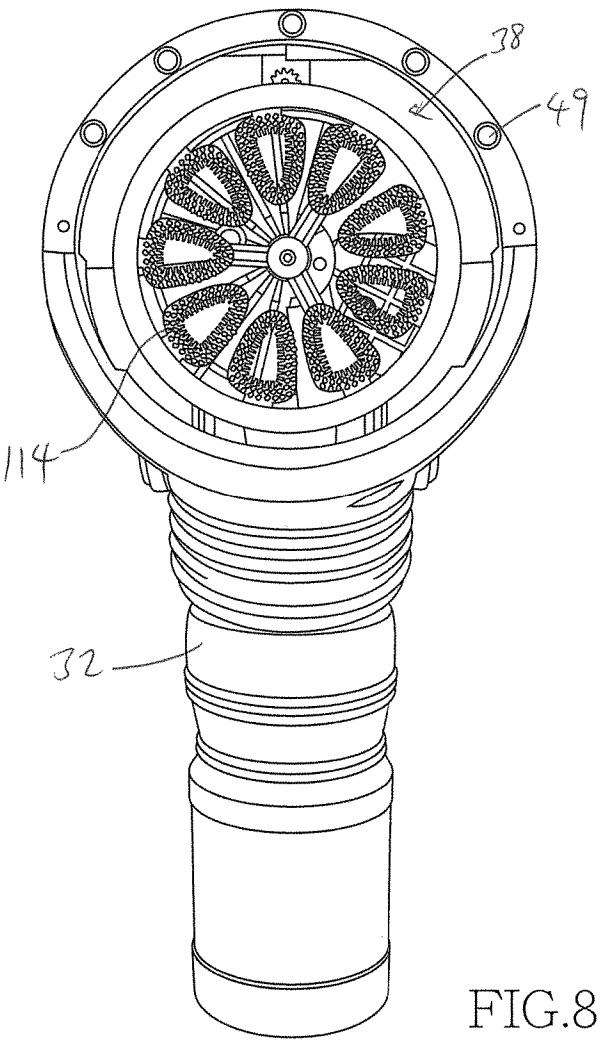
FIG. 8 is a front view of the assembly of FIG. 1 having nine bubble wands.
Figure 17:
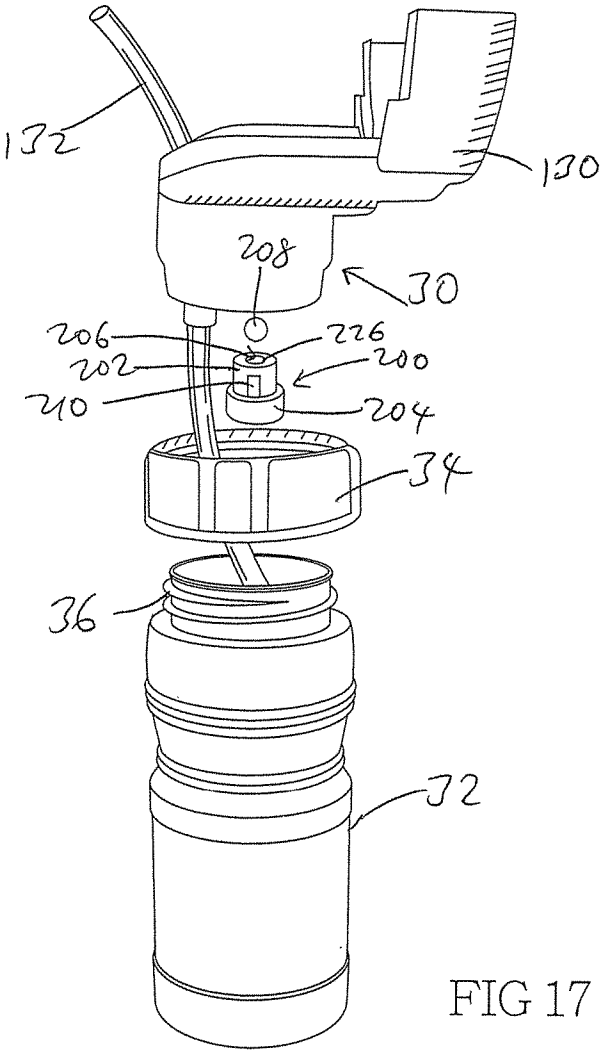
FIG. 17 is an exploded perspective view of the bubble solution container being coupled to the housing.

Referring to FIGS. 3 and 17, the lower front portion of the barrel section 24 defines a first receiving space 30 that removably couples a conventional bubble solution bottle 32. The bubble solution bottle 32 can be provided in the form of any of the conventional bubble solution containers that are currently available in the marketplace. The receiving space 30 is defined by a cap-like connector 34 which has internal threads that are adapted to releasably engage the external threads 36 on the neck of the bottle 32. In addition, a front opening 38 (see FIG. 6) is provided at the front of the barrel section 24.

Referring to FIG. 3, the rear of the barrel section 24 houses a power source 40 which can include at least one conventional battery 43. A motor 42 is part of a drive system 58 (see FIGS. 9-12) that is secured inside the housing at the barrel section 24, and the motor 42 is electrically coupled to the power source 40 via a first wire 44. A second wire 46 electrically couples the power source 40 to an LED light panel 48 that has a plurality of LED lights 49, and a third wire 50 electrically couples the LED light panel 48 to an electrical switch 52 that is seated inside a contact seat 53. A fourth wire 54 electrically couples the switch 52 to the motor 42. The electrical switch 52 is adapted to releasably contact the trigger 28, which can a push button or a switch. In addition, a spring 25 is provided inside the contact seat 53 for normally biasing the trigger 28 away from the electrical switch 52.

A pump system 60 (described in greater detail below in connection with FIG. 16) is secured inside the barrel section 24 at a position adjacent the motor 42, and is operatively coupled to the motor 42 to deliver bubble solution from the bottle 32 to the bubble generating assembly 62.

The drive system 58 is best shown in connection with FIGS. 3 and 9-12, and operates to actuate the motor 42 to simultaneously: (i) drive a link system (see FIGS. 11-12) to cause a bubble generating assembly 62 to rotate, (ii) cause the pump system 60 to deliver bubble solution from the bottle 32 to the bubble generating assembly 62, and (iii) drive a fan 64 to blow air towards the bubble generating assembly 62.

The drive system 58 includes the motor 42, the fan 64, a link system 66, and a drive housing 68 that encloses and defines an air channel 70 for directing air generated by the fan 64 to the bubble generating assembly 62. The drive housing 68 can be comprised of two shells 68*a* and 68*b* that are sealed together by screws 72. One end of the drive housing 68 has an annular flange 74 which surrounds the hub 126 (see discussion below) of the bubble generating assembly 62. A support hub 76 is provided at the top of the flange 74 and has a bore through which a link rod 78 extends.

The link system 66 has a generally annular motor support 80 that is secured to a gear bracket 82. The motor support 80 has a central hub 84 that has a bore 86 extending therethrough, with the hub 84 extending inside the gear bracket 82. Three gear shafts 88*a*, 88*b* and 88*c* are provided on a rear surface 90 of the motor support 80, are retained inside the gear bracket 82, and are each adapted to receive a separate gear 92*a*, 92*b* and 92*c*, respectively. The link rod 78 has a first ribbed wheel 94 at a front end, and a second ribbed wheel 96 adjacent its rear end. The link rod 78 is received inside a positioning bracket 98, which is located on top of the motor support 80. The ribs on the wheel 96 engage the teeth on the gear 92*a*. The motor 42 carries the fan 64 on its front end, and has a drive shaft that includes a ribbed gear 100 and a coiled gear 102. The drive shaft extends through the bore 86, and the ribs on the ribbed gear 100 engage the teeth on the gear 92*c*. As a result, the rotation of the ribbed gear 100 causes the gears 92*a*, 92*b* and 92*c* to rotate, with the rotation being translated to cause the wheel 96 to rotate, which in turn causes the wheel 94 to rotate.

Figure 7:
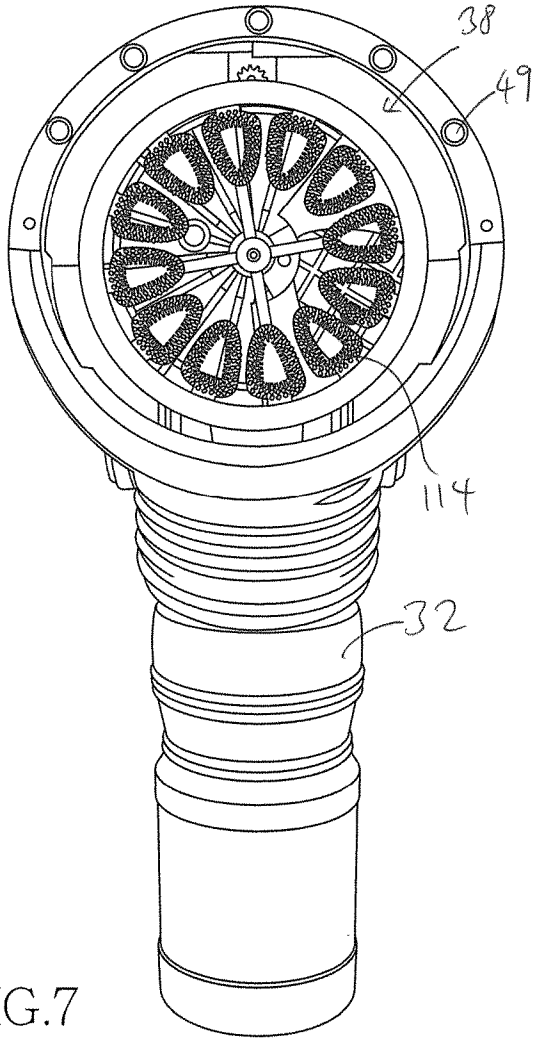
FIG. 7 is a front view of the assembly of FIG. 1 having twelve bubble wands.
Figures 9, 10:
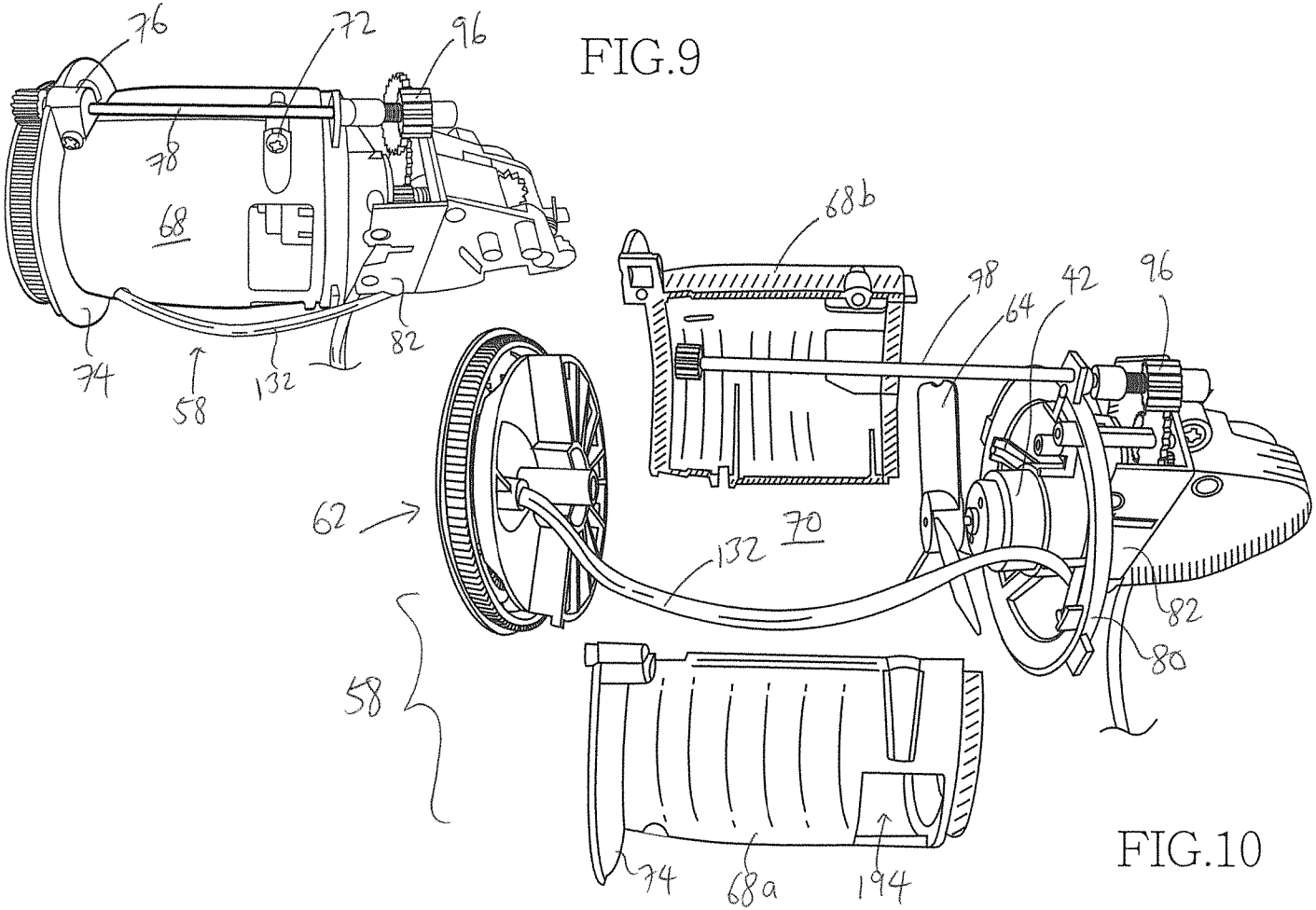
FIG. 9 is a perspective view of the inner housing and the drive system of the assembly of FIG. 1.
FIG. 10 is an exploded view of FIG. 9 with the two shells of the inner housing exploded.
Figure 11:
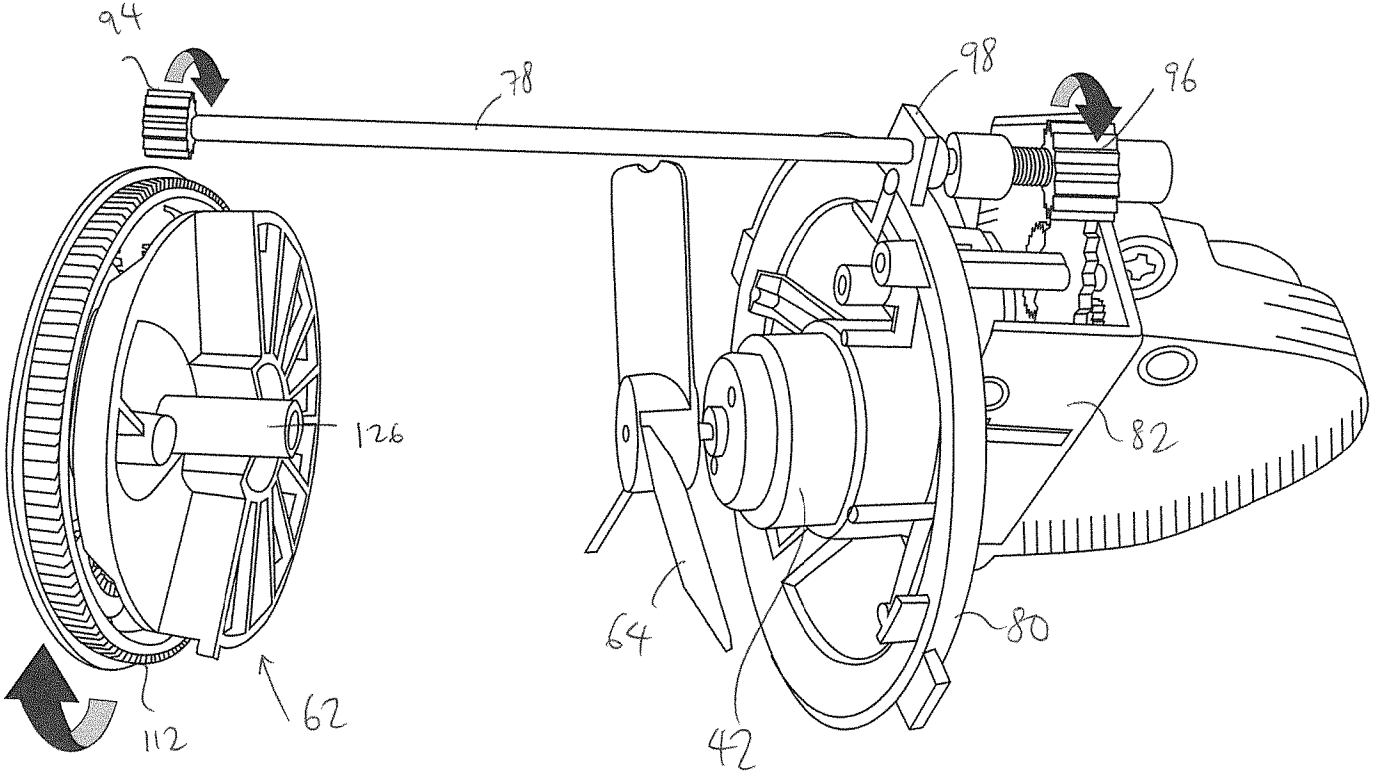
FIG. 11 is an isolated and enlarged perspective view of the link system of the assembly of FIGS. 1 and 9.
Figure 12:
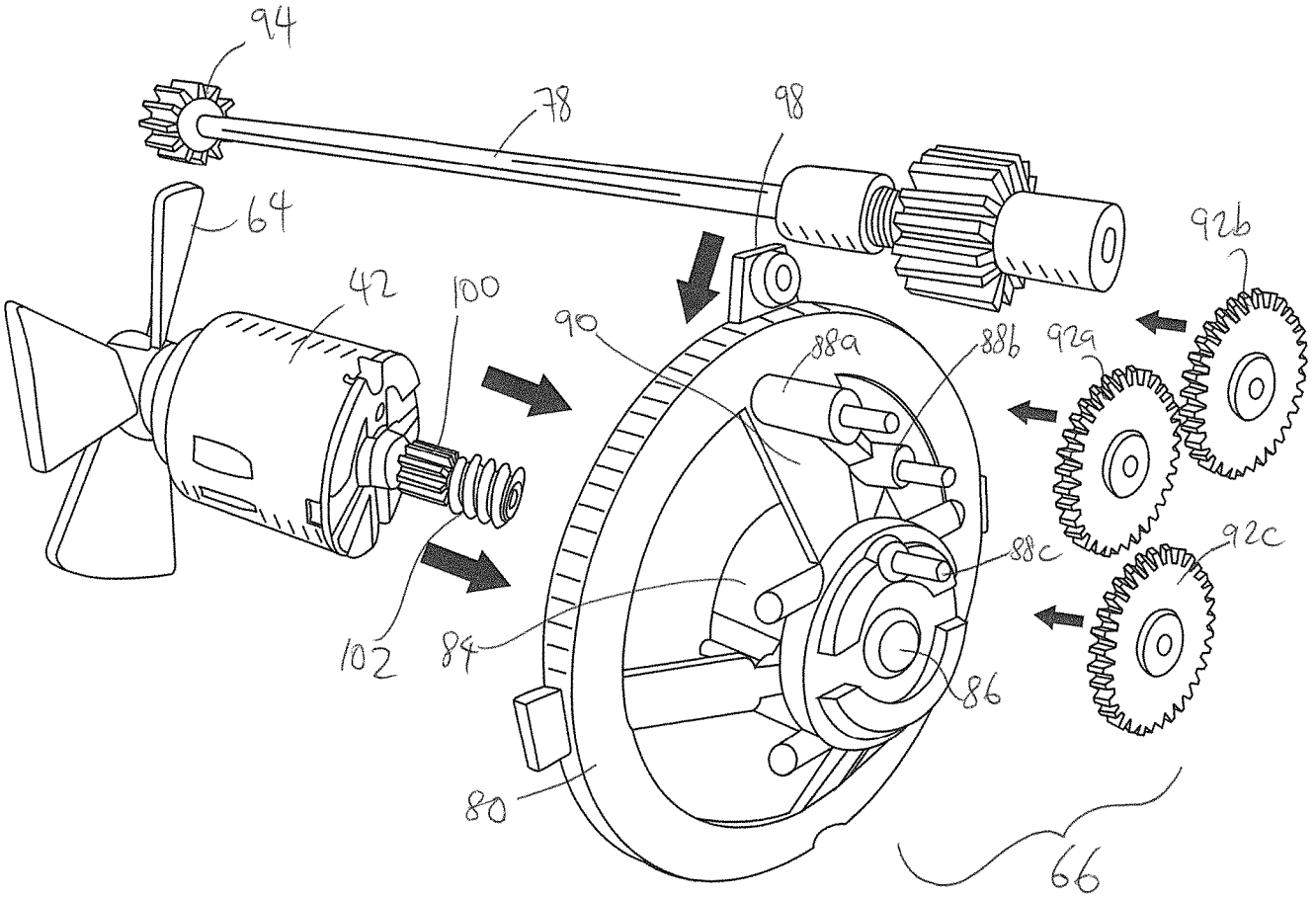
FIG. 12 is an exploded perspective view of some of the components of FIG. 11.

Referring to FIGS. 10-15, the bubble generating assembly 62 has an annular support ring 110 that has a ribbed circumferential surface 112. A plurality of bubble wands 114 are provided in spaced-apart manner around the circumference of the support ring 110. Even though FIGS. 10-15 illustrate the provision of nine bubble wands 114, any number of bubble wands 114 can be provided. For example, FIG. 7 shows the provision of twelve bubble wands 114. Dimples 122 can be provided along the front surface of the support ring 110 to aid in the formation of bubbles as the bubble solution tends to cling more effectively to uneven surfaces. The bubble wands 114 are shown as being generally triangular (with rounded corners), but can be of any shape, including square, rectangular, circular or oval.

Figure 15:
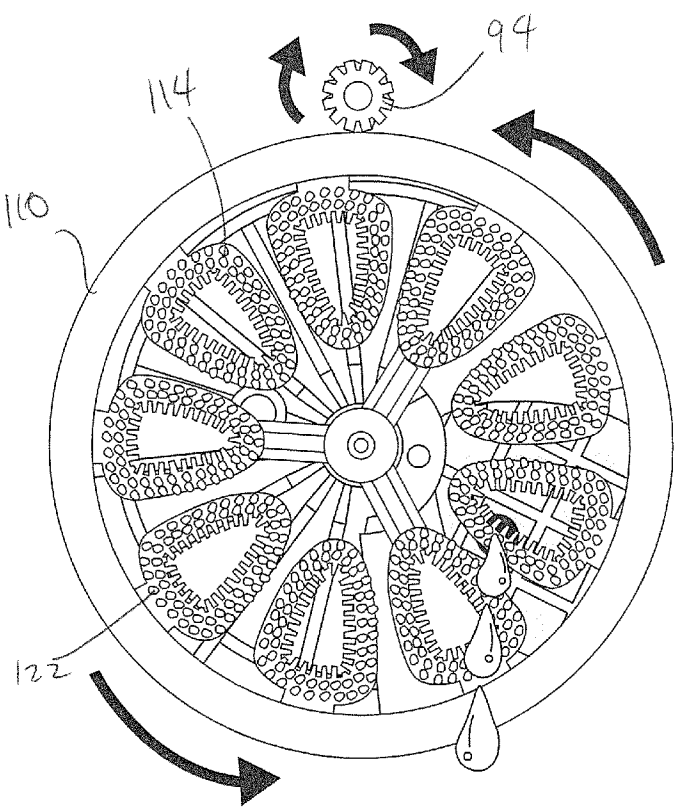
FIGS. 14 and 15 illustrate how the bubble generating assembly is rotated.
Figure 14:
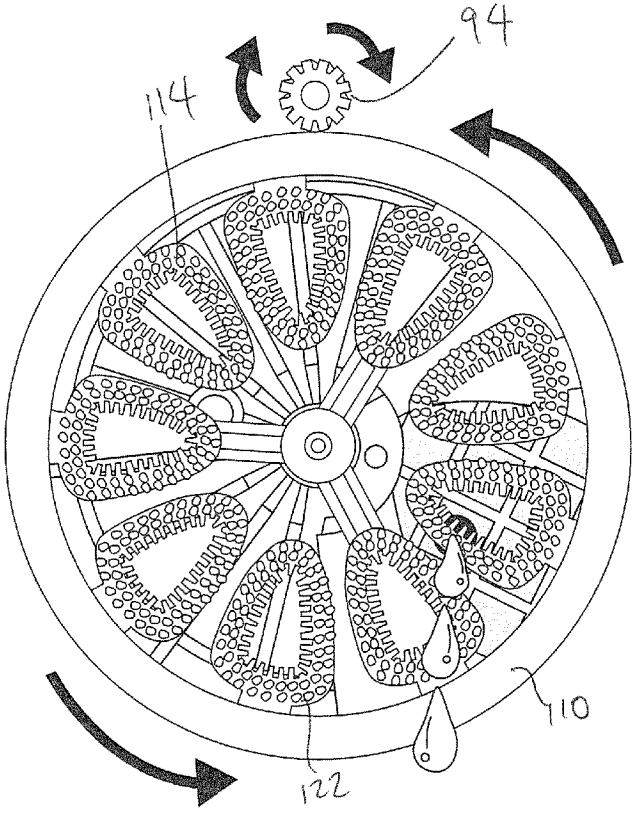

A support frame 116 extends rearwardly from the support ring 110 via a hub 126, and has a plurality of spokes 118. The support frame 116 is secured at the flange 74 so that the support frame 116 is stationary and cannot move. The support ring 110 has a shaft 119 which is received inside the hub 126 and which is rotatable about the hub 126. The ribs on the wheel 94 engage the ribs on the circumferential surface 112, so that rotation of the rod 78 and its wheel 94 will cause the support ring 110 to rotate. FIGS. 14 and 15 illustrate the rotation of the support ring 110 through two different positions to generate a bubble film on the bubble wands 114.

A stationary wiping element 125 is provided on a part of the support frame 116, and can be configured in the form of a block or housing with a hollow interior and a flat or planar front face 129. The front face 129 of the wiping element 125 can be provided with a plurality of channels or spaces 127 that are recessed or cut into the front face 129. These channels or spaces 127 define separate face pieces 120. Openings 121 can be provided on one or more of these face pieces 120 through which bubble solution can exit or leak out. The wiping element 125 is positioned between the support frame 116 and the support ring 110. The tubing 132 extends into the wiping element 125 to deliver bubble solution to the housing of the wiping element 125, and the bubble solution leaks out through the openings 121. As the support ring 110 rotates about the support frame 116, individual bubble wands 114 will wipe across the face pieces 120 to create a bubble film across the bubble wand 114.

Figure 13A:
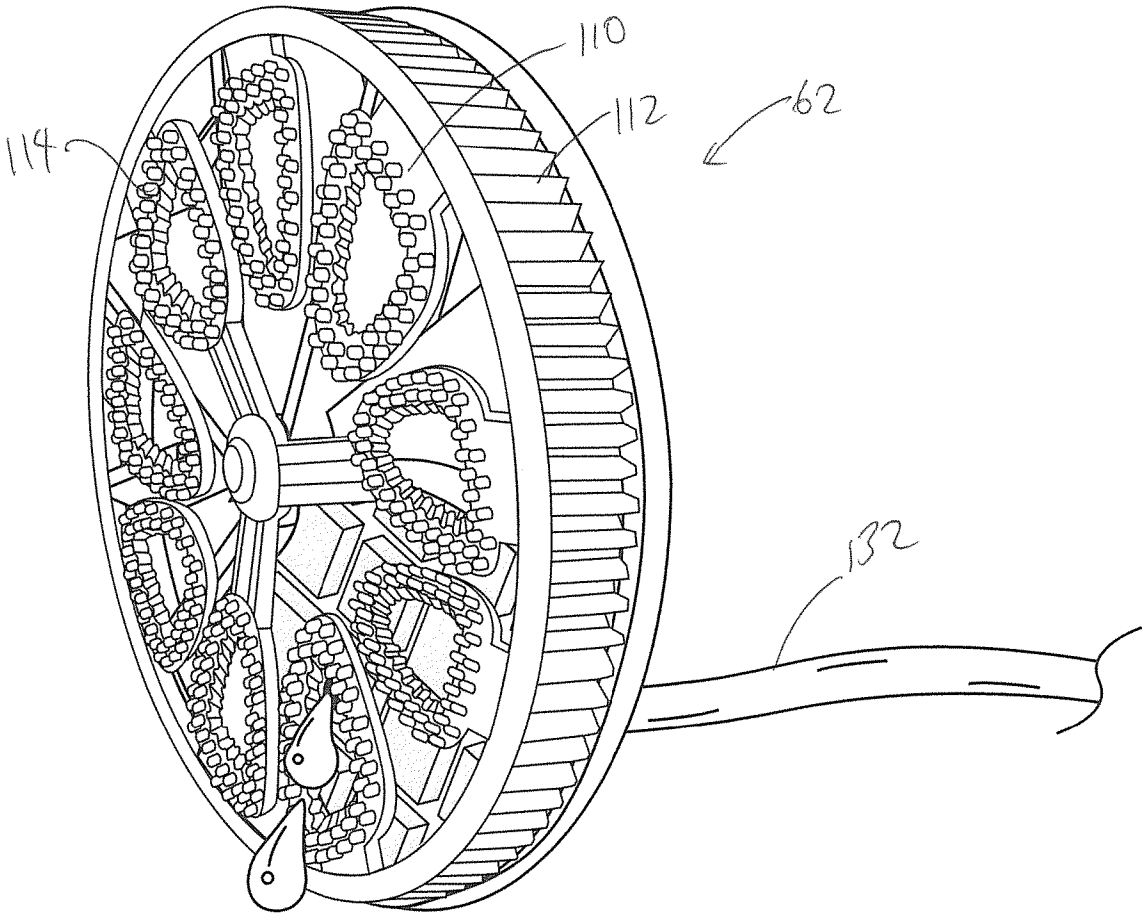
FIG. 13A is a perspective view of the bubble generating assembly.
Figure 13B:
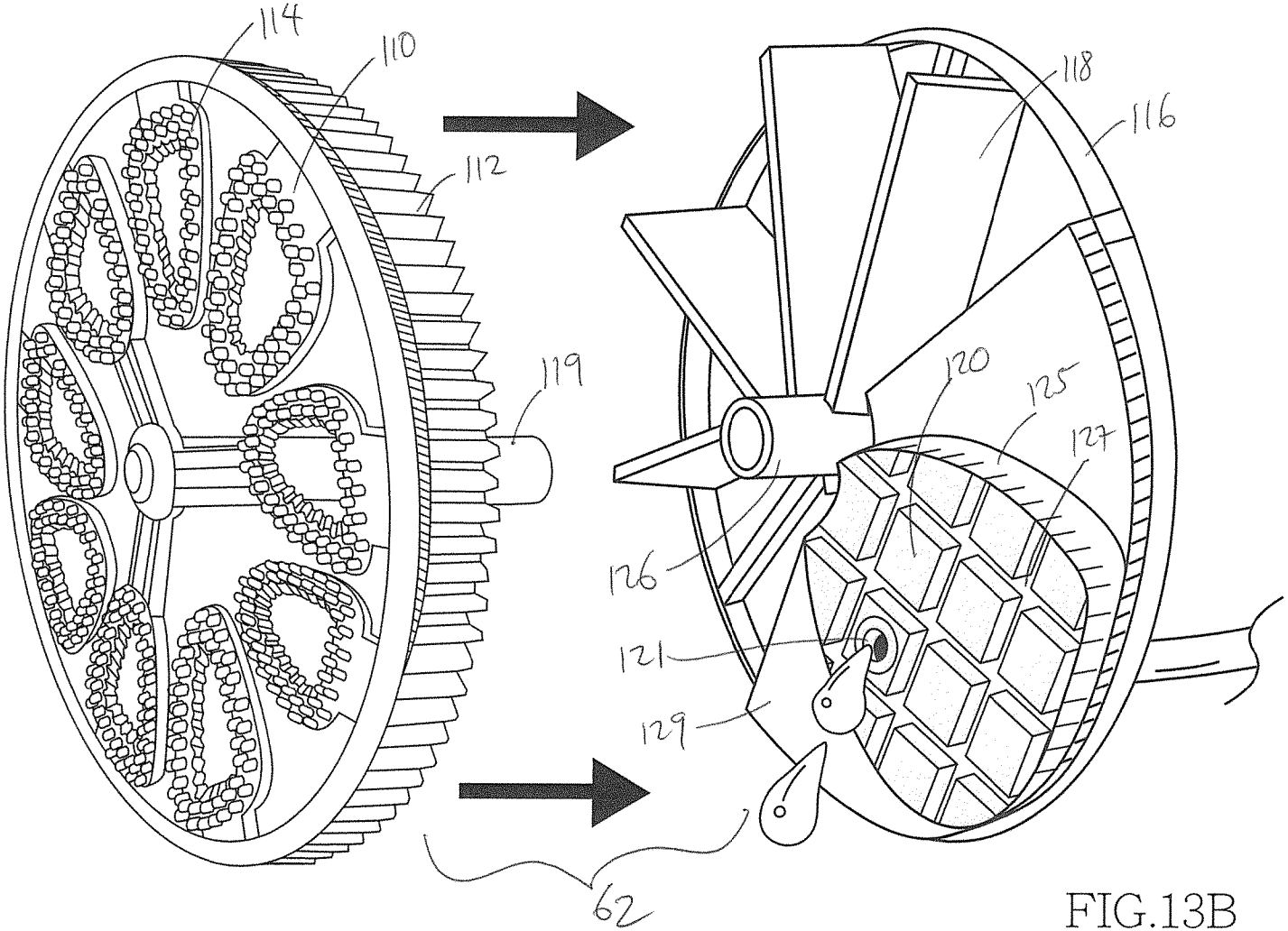
FIG. 13B is an exploded perspective view of the bubble generating assembly of FIG. 13A.

Providing a plurality of separate face pieces 120 across the front face 129 of the wiping element 125 results in more effective creation of bubbles because the uneven nature of the wiping surface created by the face pieces 120 and the spaces 127 between the face pieces 120 will create better bubble films across the bubble wands 114. The face pieces 120 are essentially separate wiping elements, and may be arranged in any manner; for example FIG. 13B illustrates the face pieces 120 arranged in a grid. In addition, the entire surface area of the front face 129 of the wiping element 125 is larger than the surface area of any of the bubble wands 114. This ensures that the entirety of each bubble wand 114 will pass through the entire front face 129, and all the face pieces 120, of the wiping element 125, which also helps to create better bubble films. This is best shown in FIGS. 14 and 15.

Figure 20:
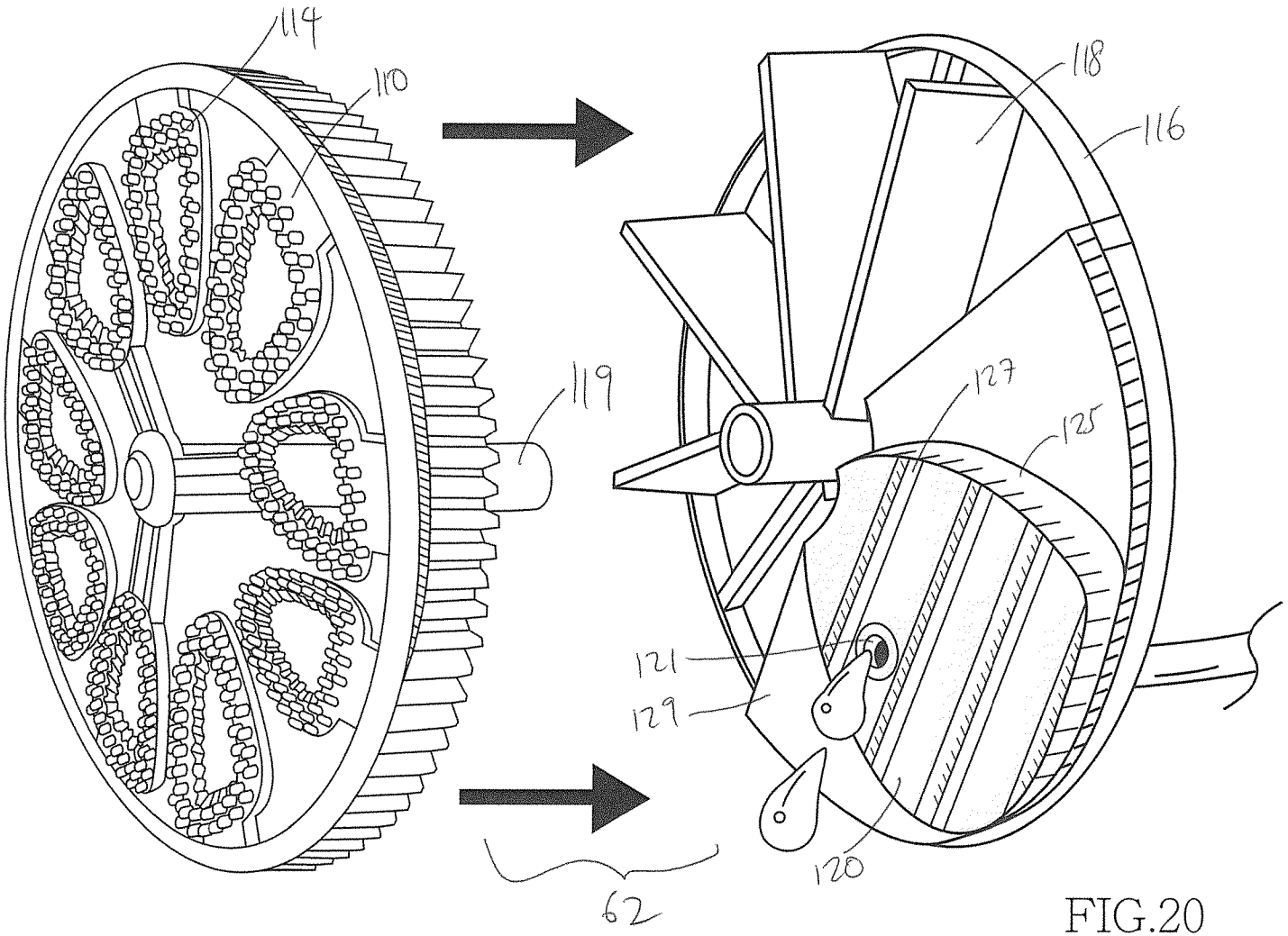
FIGS. 20-21 are exploded perspective views of alternative embodiments of the bubble generating assembly.
Figure 21:
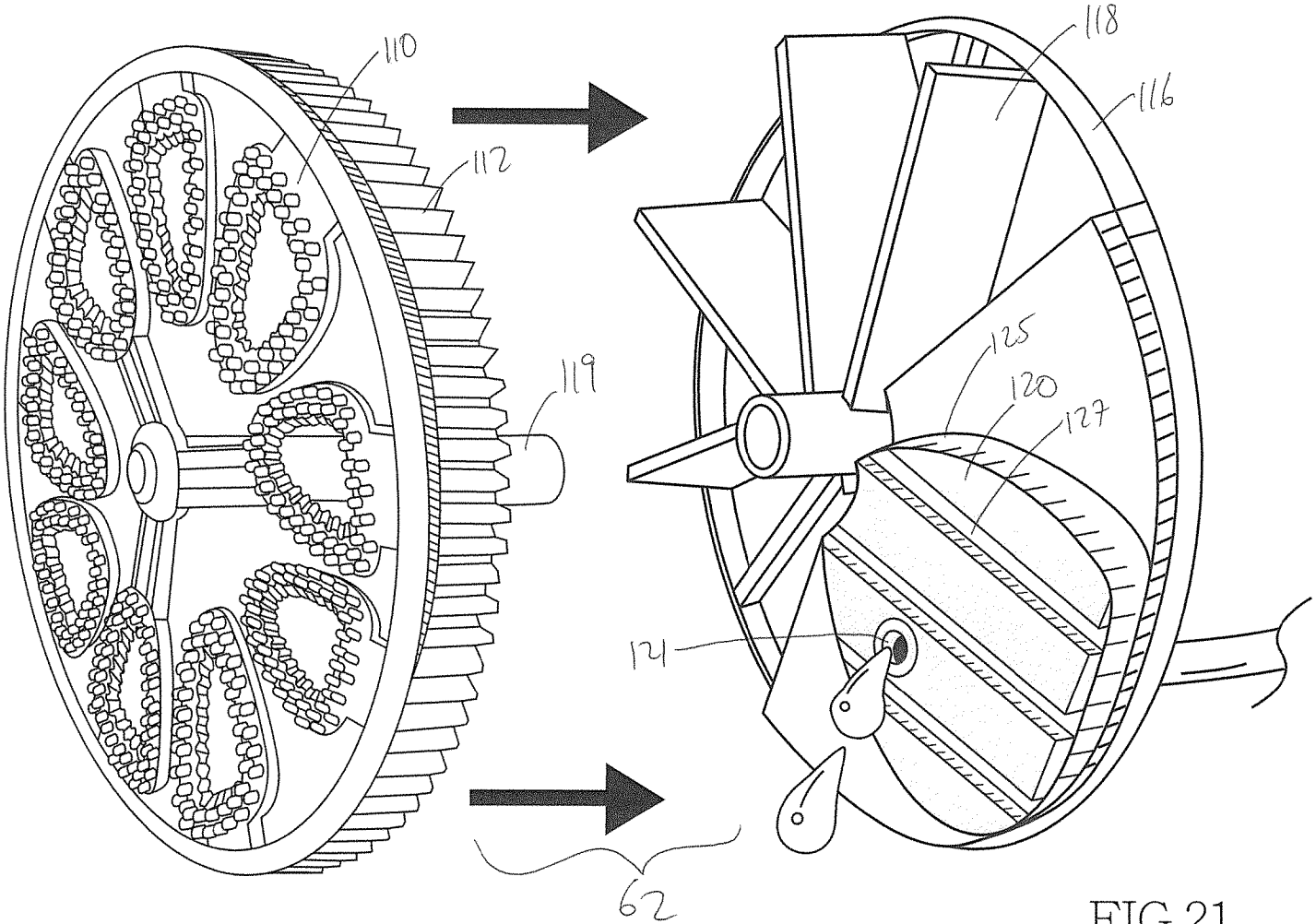

FIGS. 20-21 illustrate alternative configurations for the face pieces 120. While the face pieces 120 in FIG. 13B are square or rectangular, the face pieces 120 in FIGS. 20 and 21 are elongated bars that are oriented in different directions.

Referring to FIGS. 3, 6, 7 and 17-19, the front end of the barrel section 24 adjacent the front opening 38 defines a solution collection region 130 where bubble solution that drips from the bubble wands 114 is collected. As best shown in FIG. 17, the solution collection region 130 is a generally curved receptacle that extends forwardly from the receiving space 30, with an opening 135 separating the receptacle of the solution collection region 130 from the enclosure 222 for a collection funnel 220.

Referring now to FIGS. 3 and 16A-16C, the assembly 20 includes a pump system 60 that functions to pump the bubble solution from the solution bottle 32 to the bubble generating assembly 62. The pump system includes the motor 42, the tubing 132, an upper housing plate 134, and a lower housing plate 136 having a guide wall 138 and a circular shaft wall 139 that together defines a tubing track 137. The pump system also includes a gear system that functions to draw bubble solution through the tubing 132. The gear system includes the coiled gear 102 which is rotatably coupled to the drive shaft of the motor 42, a first pump gear 158, a second pump gear 160 and two pushers 164 and 166. The coiled gear 102 engages the teeth of the first pump gear 158. The first pump gear 158 is rotatably coupled to the housing plates 134 and 136 via a shaft 146, and has teeth that are engaged with the teeth of the second pump gear 160. The second pump gear 160 rotates about an axis defined by another shaft 148. The pushers 164, 166 are secured to the bottom side of the second pump gear 160. Each pusher 164, 166 has a generally cylindrical configuration.

Figure 16B:
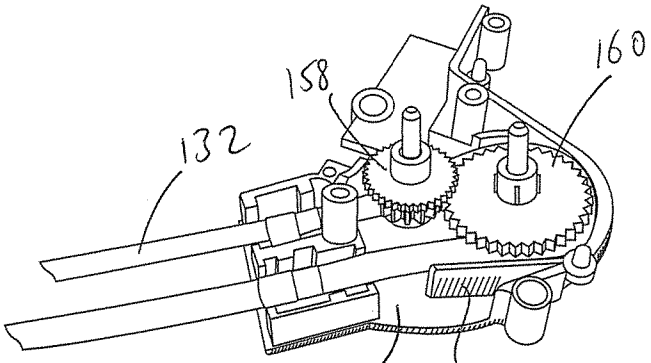
FIGS. 16B and 16C illustrate how the pump system of FIG. 16A operates.
Figure 16C:
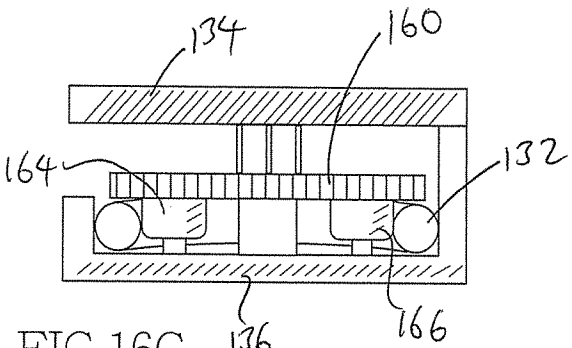
Figure 16A:
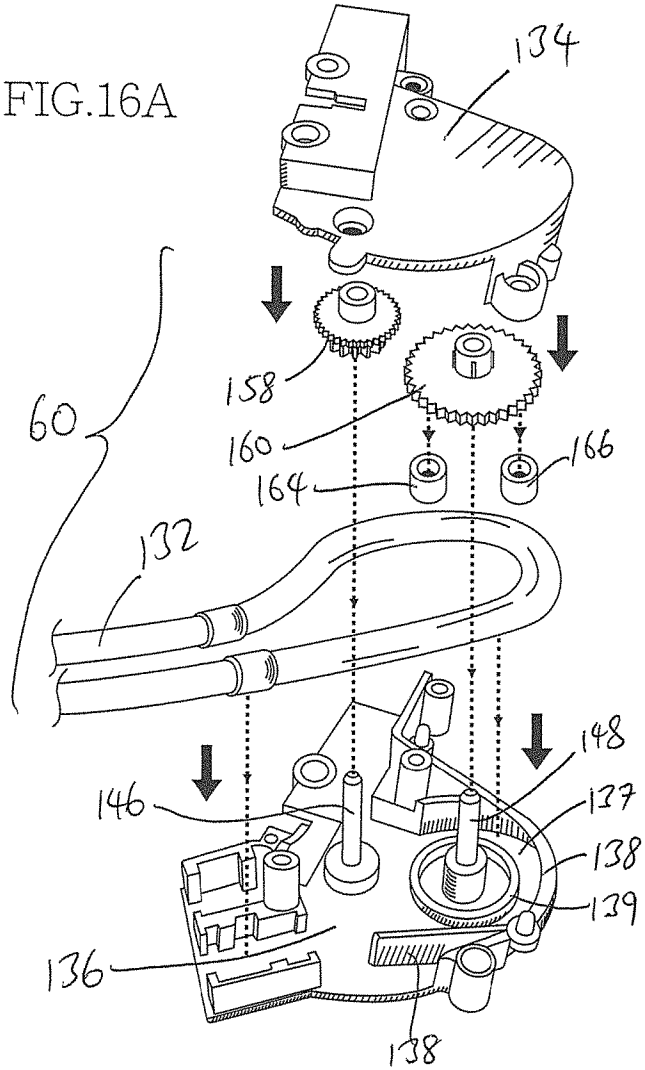
FIG. 16A is an exploded perspective view of the pump system of the assembly of FIG. 1.

As best shown in FIGS. 16B and 6C, the tubing 132 is seated inside and passes through the tubing track 137, and the pushers 164 and 166 are positioned inside the tubing track 137 and always compressing against the tubing 132. When the trigger 28 is pressed, the trigger 28 contacts the electrical switch 52 to close the circuit, thereby actuating the motor 42. The coiled gear 102 will rotate, thereby causing the first and second pump gears 158 and 160 to rotate as well. As the second pump gear 160 rotates, the pushers 164 and 166 will also rotate about the shafts 146 and 148, compressing the tubing 132 which creates pressure that causes the solution to be drawn or pumped from the bottle 32.

A fan system is illustrated in FIGS. 3 and 10-12. The fan 64 is provided inside the drive housing 68, and is rotatably coupled to the motor 42. An opening 194 is provided in the drive housing 68 to allow air from the external environment to be directed into the air channel 70, so that the fan 64 can direct the air as a stream of air through the length of the air channel 70 to the front opening 38 where the bubble generating assembly 62 is located. The stream of air can be blown against the bubble wands 114 to generate bubbles.

Figure 19:
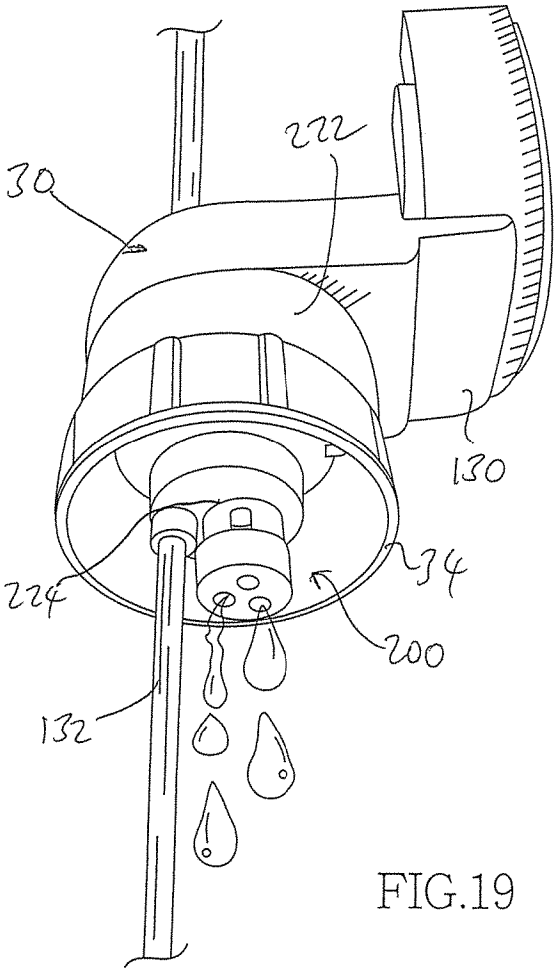
FIG. 19 illustrates the receiving space of the housing.
Figure 18:
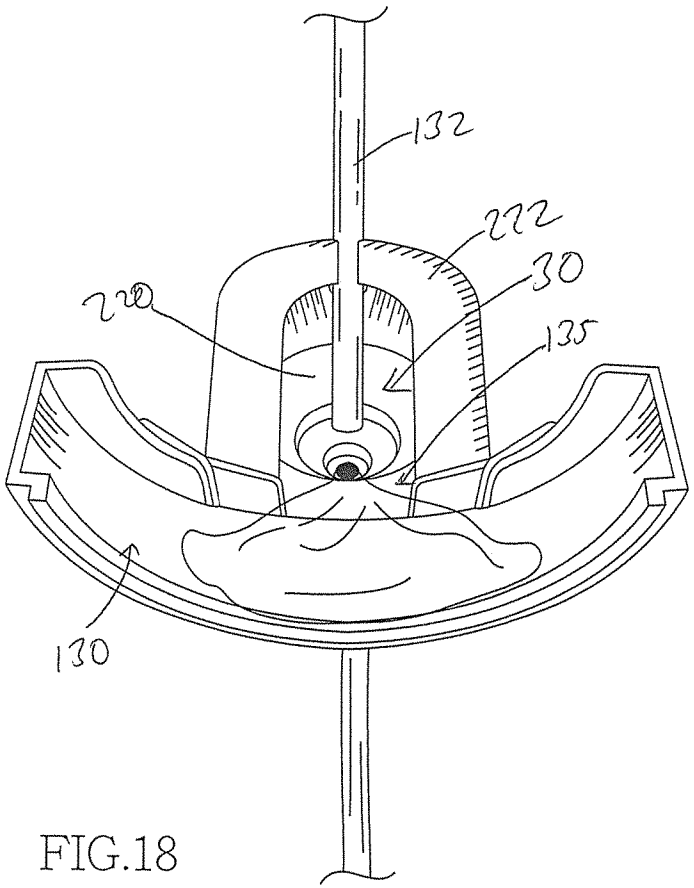
FIG. 18 illustrates the solution collection region.

Referring to FIGS. 17-19, a collection funnel 220 is positioned inside the enclosure 222 and above the connector 34. The collection funnel 220 can collect and receive droplets of bubble solution that have dripped from the bubble wands 114 into the solution collection region 130 (which communicates with the collection funnel 220), and deliver these droplets of bubble solution back into the interior of the solution bottle 32. The cap-like connector 34 is fixedly secured to the housing at a location below the collection funnel 220. The bottle 32 can be threadably connected to, and disengaged from, the connector 34. The connector 34 has a first opening through which the tubing 132 extends, and a second opening 224 that retains a valve element 200. The valve element 200 has a cylindrical body 202 with a shoulder 204 at its lower end. A bore 206 extends through the cylindrical body 202, and a ball 208 is retained inside the bore 206. The bottom wall of the cylindrical body 202 has an elongated slit 210 which has a width that is smaller than the diameter of the ball 208. Therefore, the ball 208 cannot pass through the slit 210, but can only be seated against the slit 210 in a manner that partially, but not completely, blocks the slit 210. The upper end of the cylindrical body 202 is attached to the second opening 224. In addition, the diameter of the opening 226 at the top of the bore 206 is smaller than the diameter of the ball 208, so that the ball 208 cannot pass through the opening 226 to the interior of the collection funnel 220. Thus, when the assembly 20 is oriented in the orientation shown in FIG. 1, the ball 208 will be seated at the bottom of the bore 206 against the slit 210, thereby allowing bubble solution collected by the collection funnel 220 to flow through the opening 226, the bore 206, and the portions of slit 210 that are not blocked by the ball 208, back into the solution container 32. On the other hand, if the assembly 20 is inverted (i.e., turned upside down), the ball 208 will be abutted against the opening 226, and will completely block the opening 226, so that bubble solution from the solution container 32 can flow through the slit 210 and the bore 206, but cannot be spilled through the second opening into the interior of the collection funnel 220.

An optional LED light panel 48 having a plurality of LED lights 49 can be secured to the front opening 38, with a lens cover 230 secured on top of the LED light panel 48. In this embodiment five LED lights 49 are provided.

The assembly 20 operates in the following manner. In the normal (non-bubble-generating) position, the user can threadably secure the neck of the bottle 32 to the connector 34 so that the assembly 20 is ready for use.

The assembly 20 is actuated by pressing the trigger 28, which causes four sequences of events occur at about the same time.

First, bubble solution is pumped to the bubble generating assembly 62. In this regard, pressing the trigger 28 engages the electrical switch 52, thereby forming a closed electrical circuit that will deliver power from the power source 40 to the motor 42. See FIGS. 4A, 4B, 5A and 5B. The motor 42 will turn on, thereby causing the coiled gear 102 to drive and rotate the first and second pump gears 158 and 160, thereby causing the pushers 164 and 166 to rotate inside the tubing track 137. As the pushers 164 and 166 rotate, they will apply selected pressure on different parts of the tubing 132. When the pushers 164 and 166 apply pressure on the tubing 132, the tubing 132 is compressed against the guide wall 138, thereby creating air pressure to draw the bubble solution from the interior of the solution bottle 32 through the tubing 132 to the wiping element 125.

This arrangement and structure of the pushers 164, 166 is effective in prolonging the useful life of the tubing 132 and the pump system 60. In particular, the pushers 164, 166 only apply pressure against the tubing 132 when the trigger 28 is pressed, so that the tubing 132 does not experience any pressure when the trigger 28 is not pressed. This is to be contrasted with conventional pump systems used for pumping bubble solution to a bubble producing device, where pressure is always applied to the tubing regardless of whether the trigger is actuated. Over a long period of time, this constant pressure will deform the tubing, making it difficult for bubble solution to be drawn through the tubing.

Second, the support ring 110 will be rotated. As best shown in FIGS. 9-13B, when the trigger 28 is pressed, the motor 42 actuates, resulting in rotation of the ribbed gear 100, which causes the gears 92*a*, 92*b* and 92*c* to rotate, with the rotation being translated to cause the wheel 96 to rotate, which in turn causes the wheel 94 to rotate. Since the wheel 94 is engaged with the ribbed circumferential surface 112, rotation of the wheel 94 will rotate the support ring 112. As the support ring 112 rotates, each bubble wand 114 will be wiped against the front face 129 of the wiping element 125, and a film of bubble solution will be generated across the opening of the bubble wands 114.

Third, the fan 64 that is secured to the motor 42 is turned on and blows a stream of air along the air channel 70 towards the bubble wands 114. This stream of air will then travel through the film of bubble solution that has been formed over each bubble wand 114, thereby creating bubbles. Since there is a plurality of bubble wands 114, the rotation of the support ring 110 positions each bubble wand 114 in front of the air channel 70 and then moves it away for another bubble wand 114 to be positioned in front of the air channel 70. As the support ring 112 is rotated, a large stream of bubbles will be generated.

Fourth, pressing the trigger 28 closes the electrical circuit and causes the LED lights 49 on the LED light panel 48 to light up. The LED lights 49 can be made to broadcast different effects, such as different colors, flashing, etc.

Thus, pressing the trigger 28 will create a film of bubble solution across the bubble wands 114 by (i) pumping bubble solution from the solution bottle 32 to the bubble generating assembly 62, and (ii) and causing the bubble wands 114 to be rotated past the wiping element 125 so that bubble films can be created across the bubble wands 114. Pressing the trigger 28 will also actuate the fan 64 to blow streams of air at the bubble wands 114 to create bubbles.

When the user releases his or her pressing grip on the trigger 28, the spring 25 inside the contact seat 53 biases the electrical switch 52 outwardly (opposite to arrow R in FIG. 1) to cause the switch 52 to push the trigger 28 to return to its rest position (FIGS. 7, 15B and 15D), causing three events to occur.

First, the trigger 28 will be separated from the switch 52 so that the electrical circuit is opened, thereby cutting power to the motor 42 and the LEDs. As a result, the fan 64 will stop producing streams of air and the LED lights 49 will stop lighting up. This is the first event.

The second event is that the pump system 60 will stop drawing bubble solution from the solution bottle 32 to the wiping element 125. This occurs because power to the motor 42 has been cut so that the gears 102, 158 and 160 stop rotating, which means that the pushers 164 and 166 will stop rotating.

In the third event, the link system 66 will stop rotating the wheel 94, thereby stopping rotation of the support ring 112. When power to the motor 42 is cut, the ribbed gear 100 stops rotating, so that the other gears 92*a*, 92*b*, 92*c*, the wheel 96 and the link rod 78 all stop rotating. As a result, no bubbles will be generated.

In addition, the collection funnel 220 is fluidly connected with the solution collection region 130 to collect any stray droplets of bubble solution that drip from the bubble wands 114. These stray droplets can flow back into the solution bottle 32 via the collection funnel 220 and the valve element 200. In addition, the solution bottle 32 can be removed from the housing by threadably disengaging the neck of the solution bottle 32 from the connecting section 34, so as to replenish or replace the supply of bubble solution.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating device, comprising:

a housing having a front opening;

a bubble generating assembly positioned adjacent the front opening and having:

a support frame having a stationary wiping element, the wiping element having a front face that has an opening through which bubble solution leaks out, the front face having a surface area;

a support ring and a plurality of bubble wands provided on the support ring, with the support ring coupled to the support frame for rotation in a manner where each of the plurality of bubble wands individually wipes across the wiping element at the location of the opening, wherein each of the plurality of bubble wands has a surface area that is smaller than the entire surface area of the wiping element;

a motor positioned inside the housing and having a fan that is directed to blow air towards the front opening;

a container coupled to the housing and retaining bubble solution, the container having an interior;

a tubing that couples the interior of the container with the wiping element;

a pump system coupled to the motor, and actuated by the motor, that delivers bubble solution from the interior of the container through the tubing and to the wiping element; and a link assembly that couples the motor and the support ring in a manner in which actuation of the motor causes the support ring to be rotated so that each of the plurality of bubble wands is wiped across the wiping element and then positioned in front of the fan to receive air blown by the fan.

2. The device of claim 1, wherein the support ring rotates in a vertical circular plane.

3. The device of claim 1, further including a solution collection region positioned adjacent the front opening, wherein the solution collection region comprises a receptacle, with the container fluidly coupled to the receptable, wherein bubble solution that drips from the plurality of bubble wands is collected at the receptacle and drips back into the container.

4. The device of claim 1, wherein the front face has an array of separate face pieces.

5. The device of claim 1, further including a plurality of LED lights positioned at the front opening.

6. The device of claim 1, wherein the plurality of bubble wands comprises nine bubble wands.

7. The device of claim 1, wherein the plurality of bubble wands comprises twelve bubble wands.

8. The device of claim 1, wherein the front face has a plurality of recessed channels.

9. A bubble generating device, comprising:

a housing having a front opening;

a bubble generating assembly positioned adjacent the front opening and having:

a support frame having a stationary wiping element, the wiping element having a front face that has a plurality of recessed channels, with the front face having an opening through which bubble solution leaks out;

a support ring and a plurality of bubble wands provided on the support ring, with the support ring coupled to the support frame for rotation in a manner where each of the plurality of bubble wands individually wipes across the wiping element at the location of the opening;

a motor positioned inside the housing and having a fan that is directed to blow air towards the front opening;

a container coupled to the housing and retaining bubble solution, the container having an interior;

a tubing that couples the interior of the container with the wiping element;

a pump system coupled to the motor, and actuated by the motor, that delivers bubble solution from the interior of the container through the tubing and to the wiping element; and a link assembly that couples the motor and the support ring in a manner in which actuation of the motor causes the support ring to be rotated so that each of the plurality of bubble wands is wiped across the wiping element and then positioned in front of the fan to receive air blown by the fan.

10. The device of claim 9, wherein the support ring rotates in a vertical circular plane.

11. The device of claim 9, further including a solution collection region positioned adjacent the front opening, wherein the solution collection region comprises a receptacle, with the container fluidly coupled to the receptable, wherein bubble solution that drips from the plurality of bubble wands is collected at the receptacle and drips back into the container.

12. The device of claim 9, wherein the front face of the wiping element has an array of separate face pieces.

13. The device of claim 9, further including a plurality of LED lights positioned at the front opening.

14. The device of claim 9, wherein the plurality of bubble wands comprises nine bubble wands.

15. The device of claim 9, wherein the plurality of bubble wands comprises twelve bubble wands.

16. The device of claim 9, wherein the front face has a surface area, and each of the plurality of bubble wands has a surface area that is smaller than the entire surface area of the front face of wiping element.

* * * * *